US007958689B2

(12) United States Patent
Lei

(10) Patent No.: US 7,958,689 B2
(45) Date of Patent: Jun. 14, 2011

(54) FLOOR PANEL WITH COUPLING DEVICES

(75) Inventor: Xiang Lei, Chuzhou (CN)

(73) Assignee: Anhui Yangzi Flooring Incorporated Company, Chuzhou, Anhui (CN)

( * ) Notice: Subject to any disclaimer, the term of this patent is extended or adjusted under 35 U.S.C. 154(b) by 60 days.

(21) Appl. No.: 12/554,936

(22) Filed: Sep. 7, 2009

(65) Prior Publication Data

US 2010/0058702 A1 Mar. 11, 2010

(30) Foreign Application Priority Data

Sep. 10, 2008 (CN) ..... 2008 1 0198567

(51) Int. Cl.
*E04F 15/00* (2006.01)
*E04C 2/30* (2006.01)

(52) U.S. Cl. ..... 52/592.1; 428/192; 52/588.1

(58) Field of Classification Search ..... 52/592.1, 52/588.1

See application file for complete search history.

(56) References Cited

U.S. PATENT DOCUMENTS

| | | | | |
|---|---|---|---|---|
| 2,398,632 | A * | 4/1946 | Frost et al. | 428/309.9 |
| 5,570,554 | A * | 11/1996 | Searer | 52/539 |
| 6,505,452 | B1 * | 1/2003 | Hannig et al. | 52/582.1 |
| 6,804,926 | B1 * | 10/2004 | Eisermann | 52/592.1 |
| 6,865,856 | B2 * | 3/2005 | Kim et al. | 52/592.1 |
| 6,928,779 | B2 * | 8/2005 | Moriau et al. | 52/403.1 |
| 7,146,772 | B2 * | 12/2006 | Ralf | 52/592.1 |
| 7,168,217 | B2 * | 1/2007 | Weber | 52/592.1 |
| 7,506,481 | B2 * | 3/2009 | Grafenauer | 52/592.1 |
| 7,596,920 | B2 * | 10/2009 | Konstanczak | 52/589.1 |
| 7,617,651 | B2 * | 11/2009 | Grafenauer | 52/592.1 |
| 7,827,749 | B2 * | 11/2010 | Groeke et al. | 52/316 |
| 2003/0029115 | A1 * | 2/2003 | Moriau et al. | 52/592.1 |
| 2003/0188504 | A1 * | 10/2003 | Ralf | 52/578 |
| 2003/0224147 | A1 * | 12/2003 | Maine et al. | 428/192 |
| 2004/0123547 | A1 * | 7/2004 | Grafenauer | 52/578 |
| 2004/0200175 | A1 * | 10/2004 | Weber | 52/592.1 |
| 2005/0005559 | A1 * | 1/2005 | Ralf | 52/589.1 |
| 2007/0062148 | A1 * | 3/2007 | Nienhuis et al. | 52/592.1 |
| 2007/0107362 | A1 * | 5/2007 | Weber | 52/592.1 |
| 2007/0107363 | A1 * | 5/2007 | Moriau et al. | 52/592.1 |
| 2008/0060311 | A1 * | 3/2008 | Moriau et al. | 52/592.1 |
| 2009/0249731 | A1 * | 10/2009 | Cappelle | 52/588.1 |

* cited by examiner

*Primary Examiner* — Robert J Canfield

(57) ABSTRACT

A floor panel with coupling devices is provided. The coupling devices have locking elements which include a curved protrusion which is formed on a lower wall of an upper lip of a groove and adjacent to the entrance of the groove, and a curved recess which is formed in an upper side of a tongue and can match with the curved protrusion. Under the cooperation of the elastic deformation of the upper lip of the groove and the engagement of the locking elements, adjacent floor panels can be coupled together by exerting on them a horizontal pressing force and interlocked tightly by meshing engagement of the curved protrusion at the groove and the curved recess in the tongue without glue or other auxiliary binding material so as to ensure that the adjacent floor panels can not move in both horizontal direction and vertical direction. The floor panels are usually used in a floor decoration of indoor environment and have the advantages of easy installation and tight coupling.

10 Claims, 8 Drawing Sheets

FLOOR PANEL WITH COUPLING DEVICES

CROSS REFERENCES

The present application claims priority from Chinese Patent Application No. 200810198567.9 filed Sep. 10, 2008.

FIELD OF APPLICATION

The present application relates to a floor panel which has coupling devices to couple a plurality of separated smaller floor panels into a larger area of floor covering. Such floor panel is usually made of solid wood or synthetic fiber board and has generally the shape of a rectangle. The coupling devices usually are provided respectively in at least a longer side and a shorter side of the smaller floor panel, are used to detachably couple adjacent floor panels to form a larger area of floor covering when a floor decoration of indoor environment such as living-room or office is under way.

BACKGROUND

As a kind of indoor flooring material, wooden floor is widely used. Such wooden floor is generally assembled by coupling a plurality of smaller size floor panels together. It is known that such floor panels can be coupled in various ways. According to a first possibility, the floor panels are attached on the underlying floor or support frame, either by gluing or by nailing them on. This technique has a disadvantage in that it is rather complicated and that subsequent changes can only be made by breaking out the floor panels. According to a second possibility, the floor panels are installed loosely onto the sub-flooring, whereby the floor panels mutually match into each other by means of a tongue and groove coupling. For example, CN02803650.6 discloses a rectangular floor panel having coupling devices in form of tongues and grooves. Such floor panel comprises an undercut groove on one long side and a projecting tongue on an opposite long side of the floor panel. The undercut groove has a corresponding upward inner locking surface at a distance from its tip. Tongue and undercut groove are formed to be brought together and pulled apart by pivoting motion with a center close to the intersection between the surface planes and the common joint plane of two adjoining floor panels. Such floor panel has an advantage in that it is much cheaper and convenience to install and repair. But a disadvantage of such floor panel is that an unreasonable design of the tongue and groove possibly results in that the floor panels cannot be coupled tightly when gaps between the floor panels or bumps on the coupling surfaces occur. These defects not only affect the appearance and use of the floor covering but shorten the lifespan of the floor covering.

SUMMARY

It is aimed to provide an improved floor panel having coupling device with which a plurality of separated smaller floor panels can be coupled into a larger area of floor covering. Such floor panels can be coupled to each other in an optimum manner and adapt to an uneven floor surface, and whereby preferably one or more of the aforementioned disadvantages are excluded.

According to a first aspect, there is provided a floor panel with coupling device. The floor panel includes an upper side which is used for treading, an underside which contacts the underlying floor and a first end wall and a second end wall which are parallelly located at a distance from each other and extend in the direction perpendicular to the upper side. A groove is provided in the first end wall and adjacent the underside. The groove extends perpendicularly into the first end wall along the intersection between the upper side and the first end wall. A third end wall is formed between the groove and the underside and perpendicular to the upper side. A tongue is provided in the second end wall and adjacent the underside. The tongue extends perpendicularly outward from the second end wall along the intersection between the upper side and the second end wall. A fourth end wall is formed between the tongue and the underside and perpendicular to the upper side. The first end wall, the third end wall and the fourth end wall are parallel to each other. The groove orderly includes a first slot wall, a second slot wall, a third slot wall, a fourth slot wall, a fifth slot wall and a sixth slot wall. The first slot wall connects the first end wall and is formed by a protrusion with a curved shape which protrudes downward towards the entrance of the groove. The second slot wall, the fourth slot wall and the sixth slot wall are parallel to the upper side. The third slot wall is parallel to the first end wall and extends in the direction that the entrance of the groove dwindles to the inner bottom of the groove. The fifth slot wall is parallel to the first end wall. The tongue orderly includes a first side, a second side, a third side, a fourth side, a fifth side and a sixth side. The first side connects the second end wall and is formed by a recess with a curved shape. The second side, the fourth side and the sixth side are parallel to the upper side. The third side is parallel to the second end wall and extends in the direction that the bottom portion of the tongue dwindles to the distal tip of the tongue. The first slot wall has the same diameter and arc length as the first side of the tongue so that they can be meshingly engaged when adjacent identical ones of the floor panel are coupled together. The total length of the second slot wall and the fourth slot wall is longer than that of the second side and the fourth side of the tongue.

Preferably, the joint portion of the first slot wall and the second slot wall aligns to the plane of the third end wall in the direction perpendicular to the first end wall. The joint portion of the first side and the second side aligns to the plane of the fourth end wall in the direction perpendicular to the second end wall.

Preferably, a seventh slot wall is provided between the sixth slot wall and the third end wall of the floor panel which widens the entrance of the groove. A seventh side is provided between the sixth side and the fourth end wall so as to reinforce the bottom portion of the tongue. The seventh slot wall inclines at the same angle as the seventh side.

Preferably, the edges between the second and third sides, the fourth and fifth sides, and the fifth and sixth sides are rounded.

Preferably, the edges between the second and third sides, the fourth and fifth sides, and the fifth and sixth sides are chamfered respectively to form corresponding skew walls which maintain certain angles with their adjacent sides.

Preferably, the length of the fourth slot wall is longer than that of the fourth side.

Preferably, when the floor panel is coupled and interlocked with another identical floor panel, a gap is formed between the third end wall of the floor panel and the fourth end wall of another identical floor panel in the direction perpendicular to the first end wall of the floor panel.

The coupling devices of the floor panels are configured to enable the floor panels to be interlocked together by locking elements which include a curved protrusion which is formed on the lower wall of the upper lip of the groove and adjacent to the entrance of the groove and a curved recess which is formed in the upper side of the tongue and can match with the curved protrusion. Under the cooperation of the elastic deformation of the upper lip of the groove and the engagement of the locking elements, the adjacent floor panels can be coupled together by exerting them a horizontal pressing force and interlocked tightly by meshing engagement of the curved protrusion and the curved recess without glue or other auxiliary binding material so as to ensure that the adjacent floor panels can not move in both horizontal direction and vertical direction. The configuration of the coupling device is in such a way that the entrance of the groove is larger than its inner bottom and the tongue has the corresponding structures that the distal tip of it is smaller than its bottom portion making it easy to guide the tongue into the groove of the floor panel, which improves the location of adjacent floor panels in the direction perpendicular to the upper side of the floor panel. Meantime, the assembly of the panels with such configuration can be achieved just by exerting on the floor panels a horizontal pressing force, which permits an operator to complete the flooring at a restricted room and speeds up the coupling work. Additionally, such configuration that the lower lip of the groove is shorter than its upper lip making the lower lip more stress-tolerant and the floor covering more resistant to an uneven sub-floor surface, which promotes the floor panel's adaptability to different sub-floor surfaces. Based on the above configurations, the gaps can be formed between the groove and the tongue by regulating the length of related elements of the coupling devices. The gaps provide an operator supporting points which make it easier to couple and detach the floor panels and thus prevent the floor panels from being deadlocked.

The floor panel will be further explained in connection with the following figures.

DETAILED DESCRIPTION

Different aspects of the floor panel with coupling devices will now be described in more detail with reference to the accompanying figures. The elements, characteristics or structures of the floor panel that are equivalent to those of the floor panels in all figures have been given the same reference numbers. The floor panel with coupling devices is in no way limited to the forms of embodiment described by way of example and represented in the figures if the floor panel d can be embodied in various forms and dimensions without departing from the scope of the appended claims. For example, the various characteristics which are described by means of the represented embodiments or examples may be selectively combined with each other. Any technical solutions that are equivalent or similar to those of the floor panel with coupling devices in the present application fall into the scope of the appended claims. In addition, the describing of public-known functions and structures in the description are simplified or ignored for conciseness.

Figure 1:
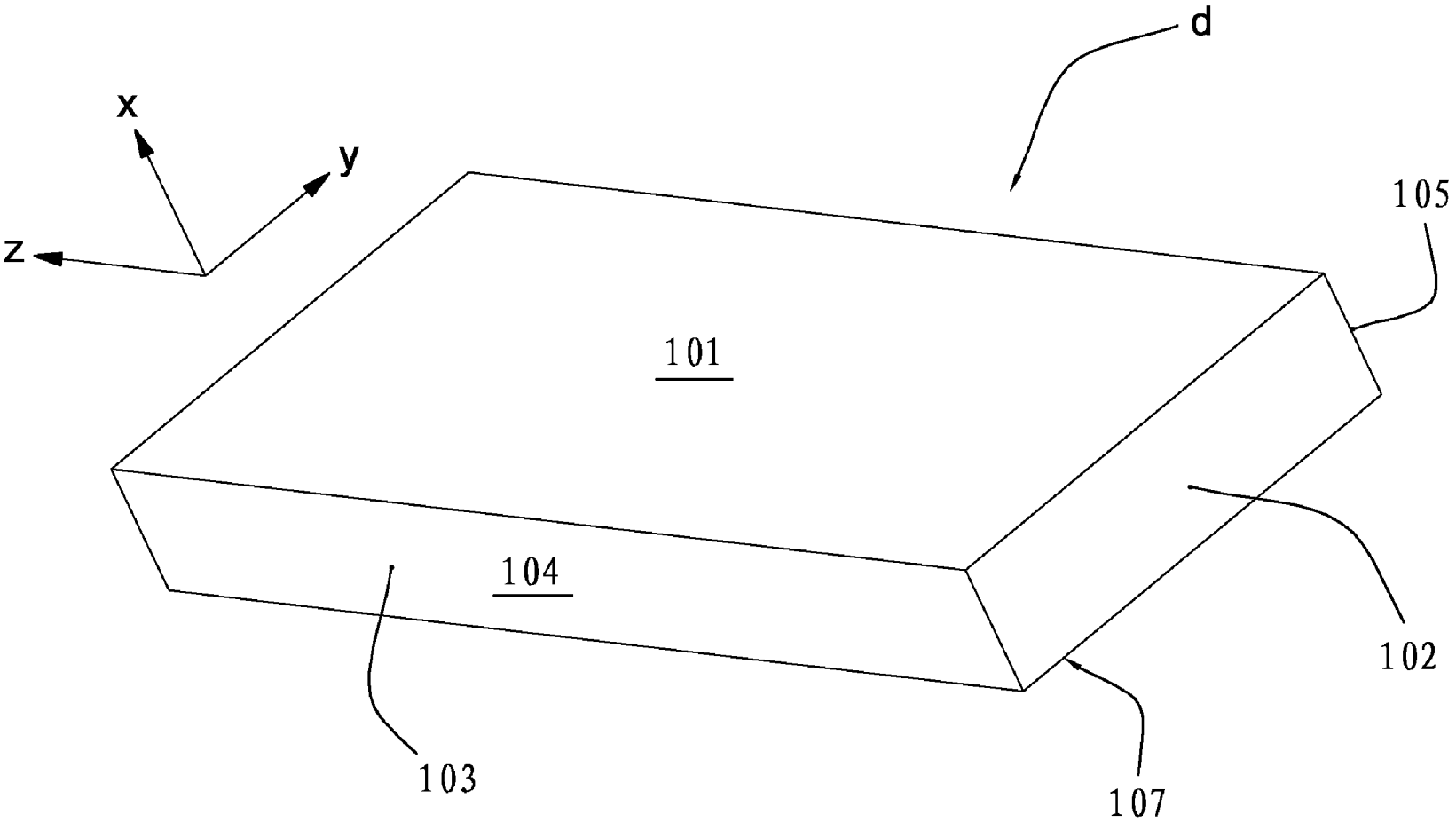
FIG. 1 is a perspective view of a floor panel before the coupling devices are formed thereon.
Figure 2:
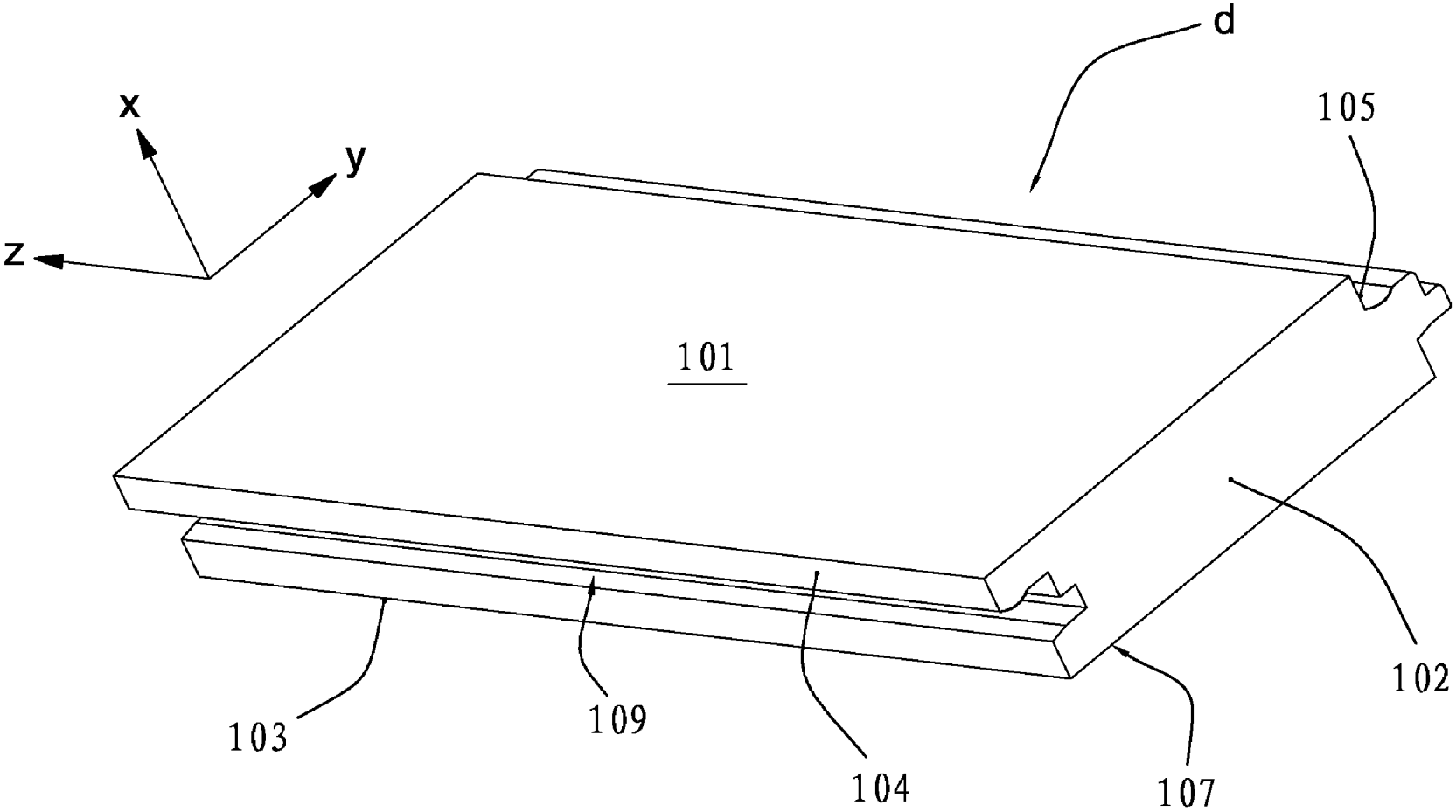
FIG. 2 is a perspective view of the floor panel formed with the coupling devices according to an embodiment disclosed in the present application.
Figure 3:
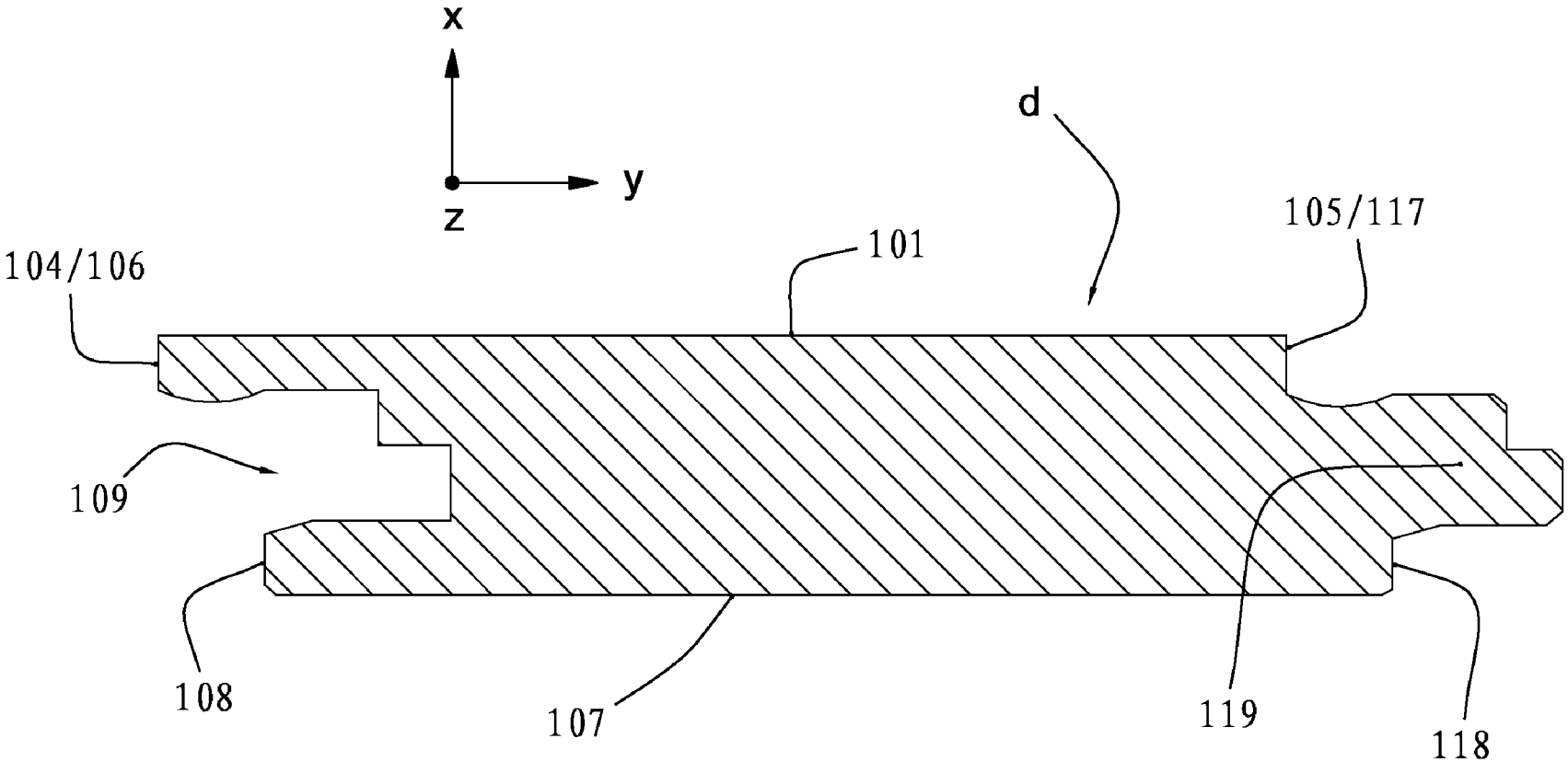
FIG. 3 is a cross sectional view of the floor panel with the coupling devices.
Figure 4:
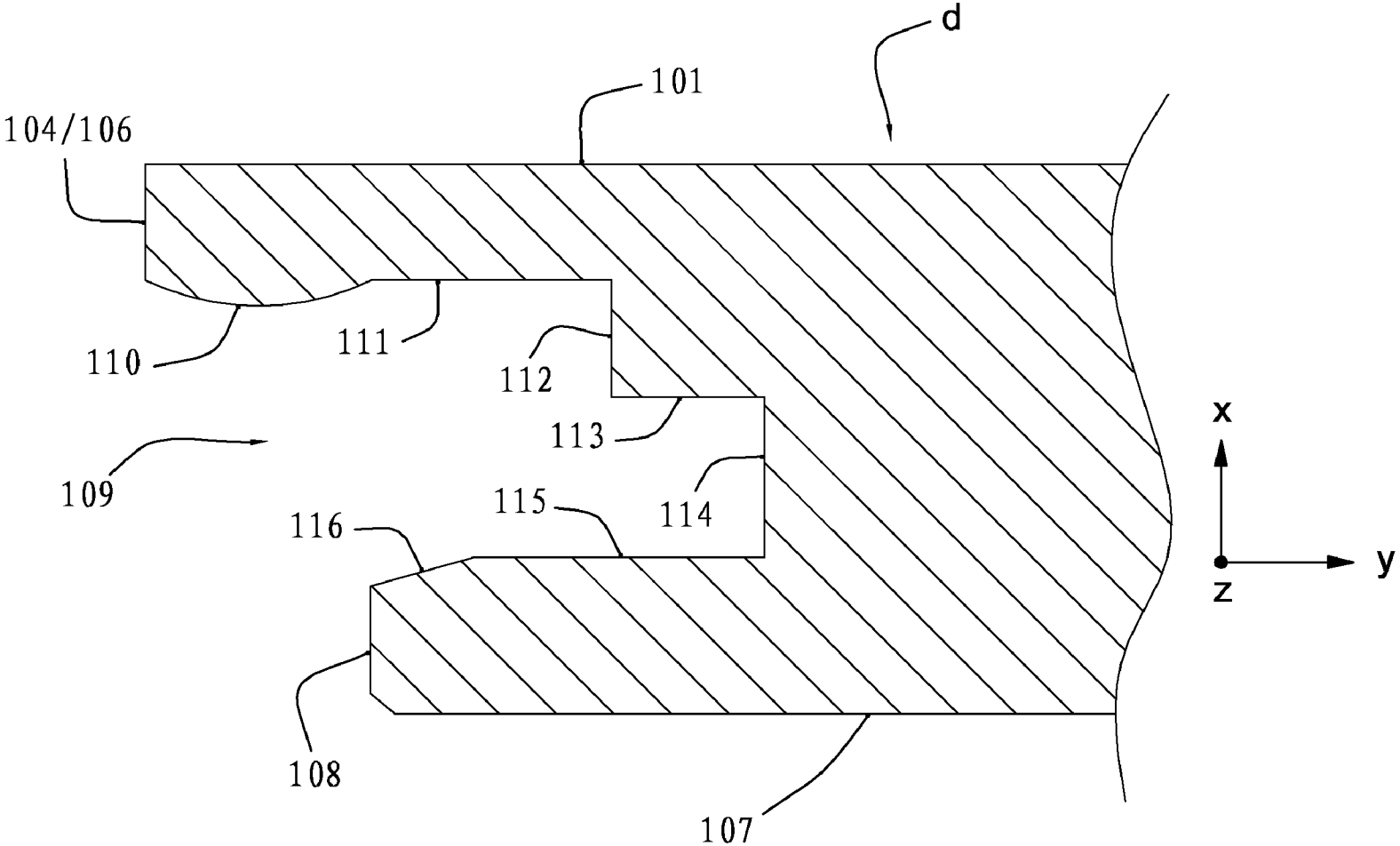
FIG. 4 is an enlarged cross sectional view of a groove of the coupling device of the floor panel.
Figure 5:
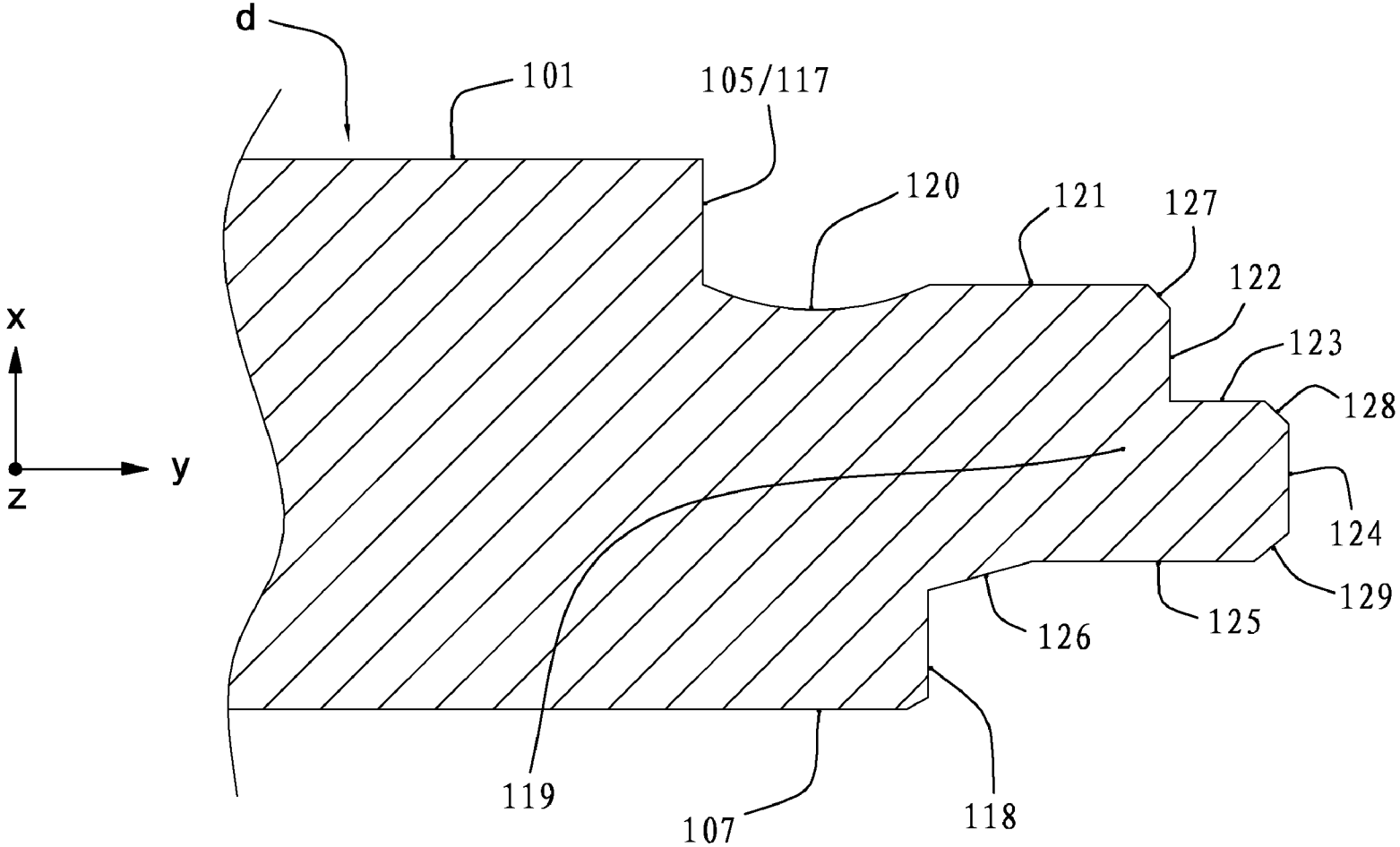
FIG. 5 is an enlarged cross sectional view of a tongue of the coupling device of the floor panel.

FIGS. 1, 2, 3, 4 and 5 represent a floor panel d. As shown in FIG. 1, the floor panel d may be in the form of a substantial rectangular solid where the coupling devices of the floor panel are not formed yet. FIG. 2 shows the floor panel d where the coupling devices have been formed. FIGS. 3, 4 and 5 represent the cross section of the floor panel with coupling devices in direction z. For better describing the examples, the coordinate system shown in FIGS. 1, 2, 3, 4 and 5 is chosen as the reference directions of the floor panel d. The reference directions are corresponding to the actual directions of the floor panel d under installing posture as follows: the direction x in the figures is corresponding to the direction perpendicular to the upper side 101 of the floor panel d, and the direction y in the figures is corresponding to the direction that is simultaneously parallel to the upper side 101and the short side 102 of the floor panel d, and the direction z in the figures is corresponding to the direction that is simultaneously parallel to the upper side 101 and the long side 103 of the floor panel d. The upper side of the panel d is parallel to the horizontal plane when the floor panel d is installed.

Generally, the floor panel d may be made of solid wood, synthetic fiber board, or any other suitable material. As shown in FIG. 1, the floor panel d may be in the form of a flat rectangular solid before its coupling devices are formed. The floor panel d may include an upper side 101, an underside 107 and four lateral walls. The upper side 101 is usually provided with a decorative layer and used to contact and support a man walking on it or other articles; and the underside 107 is provided to contact the underlying floor or supporting frame. The upper side 101 and underside 107 are parallel to each other. The lateral walls 104 and 105 are corresponding to the longer edge 103 and another two lateral wall are corresponding to the shorter edge 102. All the four lateral walls can be perpendicular to the upper side 101, i.e. the four lateral walls are parallel to the direction x. The lateral walls 104 and 105 corresponding to the longer edge 103 are parallel to the direction z and perpendicular to another two lateral walls that are corresponding to the shorter edge 102. And the two lateral walls corresponding to the shorter edge 102 are parallel to the direction y.

As represented in the FIGS. 2 to 5, the lateral walls 104 and 105 corresponding to the longer edge 103 of the floor panel d can be configured respectively as described below (the lateral walls corresponding to the shorter edge 102 can also have the similar configurations).

The portion of the lateral wall 104 adjacent to the upper side 101 can be provided as the first end wall 106. The portion of the lateral wall 104 adjacent to the underside 107 is cut away to form the third end wall 108 which is parallel to the first end wall 106. A groove 109 is provided between the first end wall 106 and the third end wall 108 and extends to the two lateral walls corresponding to the shorter edge 102 in the direction z. In other words, the groove 109 may have the same length as the lateral wall 104 and recesses the floor panel d in the direction y.

The groove 109 may include a first slot wall 110, a second slot wall 111, a third slot wall 112, a fourth slot wall 113, a fifth slot wall 114, a sixth slot wall 115 and a seventh slot wall 116. In the direction y that is also the direction that the tongue of the floor panel d is inserted into the groove 109, the upstream end of the first slot wall 110 connects to the lower side of the first end wall 106; the downstream end of the first slot wall 110 connects to the upstream end of the second slot wall 111; the downstream end of the second slot wall 111 connects to the upper side of the third slot wall 112; the lower side of the third slot wall 112 connects to the upstream end of the fourth slot wall 113; the downstream end of the fourth slot wall 113 connects to the upper side of the fifth slot wall 114; the lower side of the fifth slot wall 114 connects to the downstream end of the sixth slot wall 115; the upstream end of the sixth slot wall 115 connects to the downstream end of the seventh slot wall 116; the upstream end of the seventh slot wall 116 connects to the upper side of the third end wall 108; and the lower side of the third end wall 108 connects to the underside 107.

The first slot wall 110 may be formed by a protrusion with a curved shape which protrudes downward towards the entrance of the groove 109. The second slot wall 111, the fourth slot wall 113 and the sixth slot wall 115 are parallel to the upper side 101. The third slot wall 112 may be located substantially in the middle portion of the groove in the direction y is parallel to the first end wall 106 and extends in the direction that the entrance of the groove 109 dwindles to the inner bottom of the groove 109 which is corresponding to the fifth slot wall 114. The fifth slot wall 114 is also parallel to the first end wall 106. The seventh slot wall 116 can be configured in the form of a skew wall which inclines from the sixth slot wall 115 to the third end wall 108 or the underside 107 so that the entrance of the groove 109 is widened so as to easily guide the tongue 119. The joint portion of the downstream of the first slot wall 110 and the upstream of the second slot wall 111 aligns to the third end wall 108 in the direction y. In other words, the first slot wall 110 is in the upstream side of the third end wall 108 in the direction y. Thus, the first end wall 106 is farther away from the inner bottom of the groove 109 than the third end wall 108 in the direction y.

The portion of the lateral wall 105 adjacent to the upper side 101 can be provided as a second end wall 117. A fourth end wall 118 may be formed on an extra part that is filled up on the portion of the lateral wall 105 adjacent to the underside 107. The extra part may be made of the same material as the floor panel d. Herein the extra part is described in relation to the lateral wall 105, and actually, the extra part can also be looked as the original parts of the floor panel d. The fourth end wall 118 is parallel to the second end wall 117. A tongue 119 can be provided between the second end wall 117 and the fourth end wall 118 and protrudes outward from the lateral wall 105 in the direction of y. The tongue 119 extends in the direction z to the two lateral walls which are corresponding to the shorter edge 102. In other words, the tongue 119 has the same length as the lateral wall 105 and the groove 109 in the direction z.

The tongue 119 may include a first side 120, a second side 121, a third side 122, a fourth side 123, a fifth side 124, a sixth side 125 and a seventh side 126. In the direction of y which is also the direction that the tongue 119 is inserted into the groove 109, the upstream end of the first side 120 connects to the lower side of the end wall 117; the downstream end of the first side 120 connects to the upstream end of the second side 121; the downstream end of the second side 121 connects to the upper side of the third side 122 by a skew wall 127; the lower side of the third side 122 connects to the upstream end of the fourth side 123; the downstream end of the fourth side 123 connects to the upper side of the fifth side 124 by a skew wall 128; the lower side of the fifth side 124 connects to the downstream end of the sixth side 125 by a skew wall 129, the upstream end of the sixth side 125 connects to the downstream end of the seventh side 126; and the upstream end the seventh side 126 connects to the upper side of the fourth end wall 118.

The skew walls 127, 128 and 129 can be configured to maintain certain angles with their adjacent sides. Alternatively, the skew walls 127, 128 and 129 can be configured in a round chamfering form. The first side 120 may be formed by a downward recess with a curved shape. The second side 121, the fourth side 123 and the sixth side 125 are parallel to the upper side 107. The third side 122 may be located substantially in the middle portion of the tongue 119 in the direction y is parallel to the second end wall 117 and extends in the direction that the bottom portion of the tongue 119 dwindles to the distal tip of the tongue 119 which is corresponding to the fifth side 124. The fifth side 124 is parallel to the second end wall 117. The seventh side 126 may be configured in the form of a skew wall which inclines from the sixth side 125 to the fourth end wall 118 or the underside 107 so as to reinforce the bottom portion of the tongue 119. The joint portion of the downstream of the first side 120 and the upstream of the second side 121 aligns to the fourth end wall 118 in the direction y. In other words, the fourth end wall 118 is in the downstream side of the second end wall 117 in the direction y.

Figure 8:
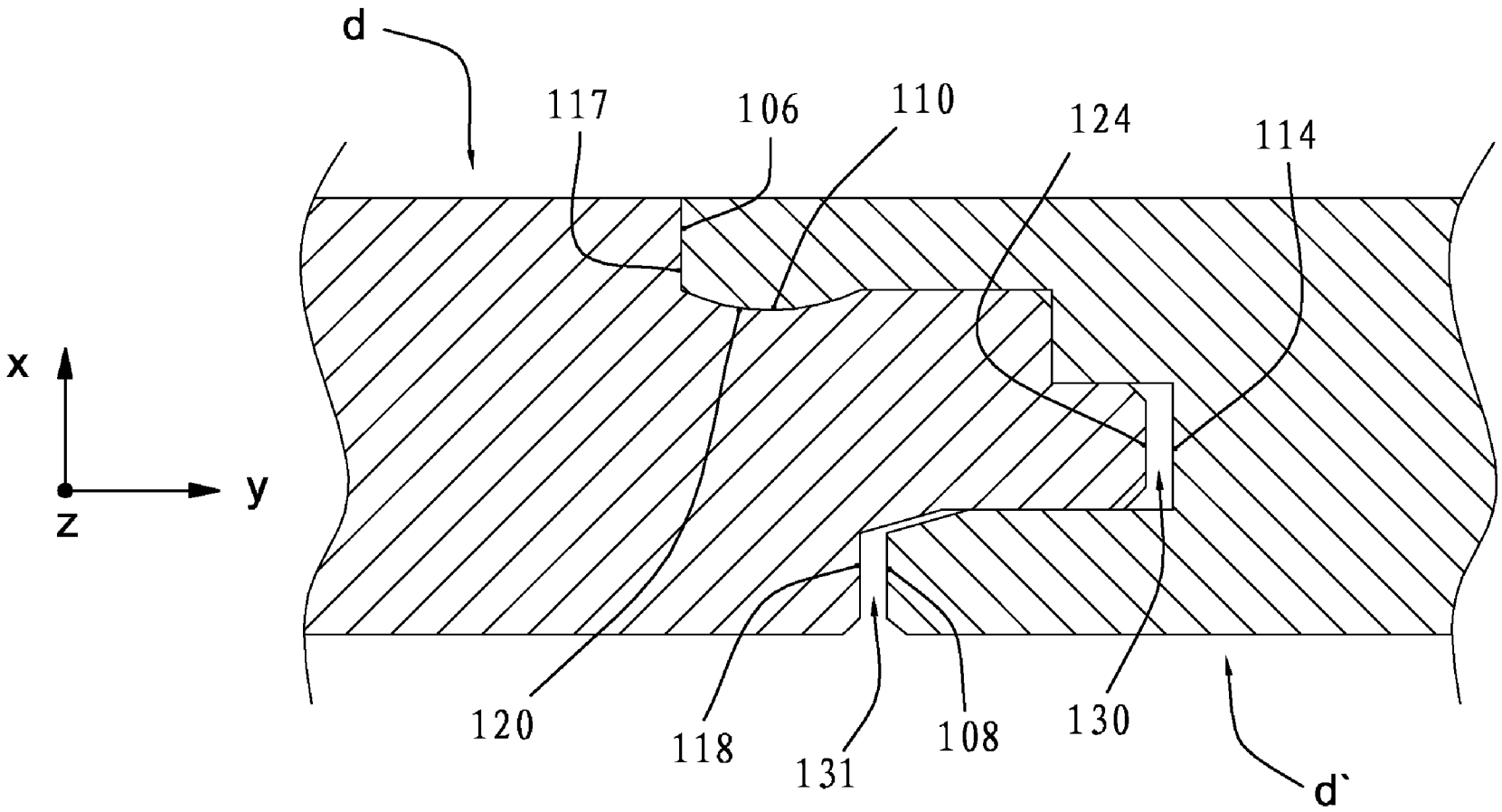
FIG. 8 shows an interlocking stage when two identical floor panels with coupling devices of FIG. 2 are coupled together.

The first slot wall 110 of the groove 109 may have the same arc length and diameter of the curved surface as the first side 120 of the tongue 119. The seventh slot wall 116 is parallel to the seventh side 126, i.e. the angle between the seventh slot wall 116 and the sixth slot wall 115 is equal to the one between the seventh side 126 and the sixth side 125. The total length of the second slot wall 111 and the fourth slot wall 113 may be longer than that of the second side 121 and the fourth side 123 so that a gap 130 can be formed between the fifth slot wall 114 of one floor panel and the fifth side 124 of another identical floor panel in the direction y when the two same floor panels are coupled together, as shown in FIG. 8. Of course, the gap 130 between the fifth slot wall 114 and the fifth side 124 of two floor panels can also be formed by the fourth slot wall 113 configured longer than the fourth side 123 in the same floor panel.

Figure 6:
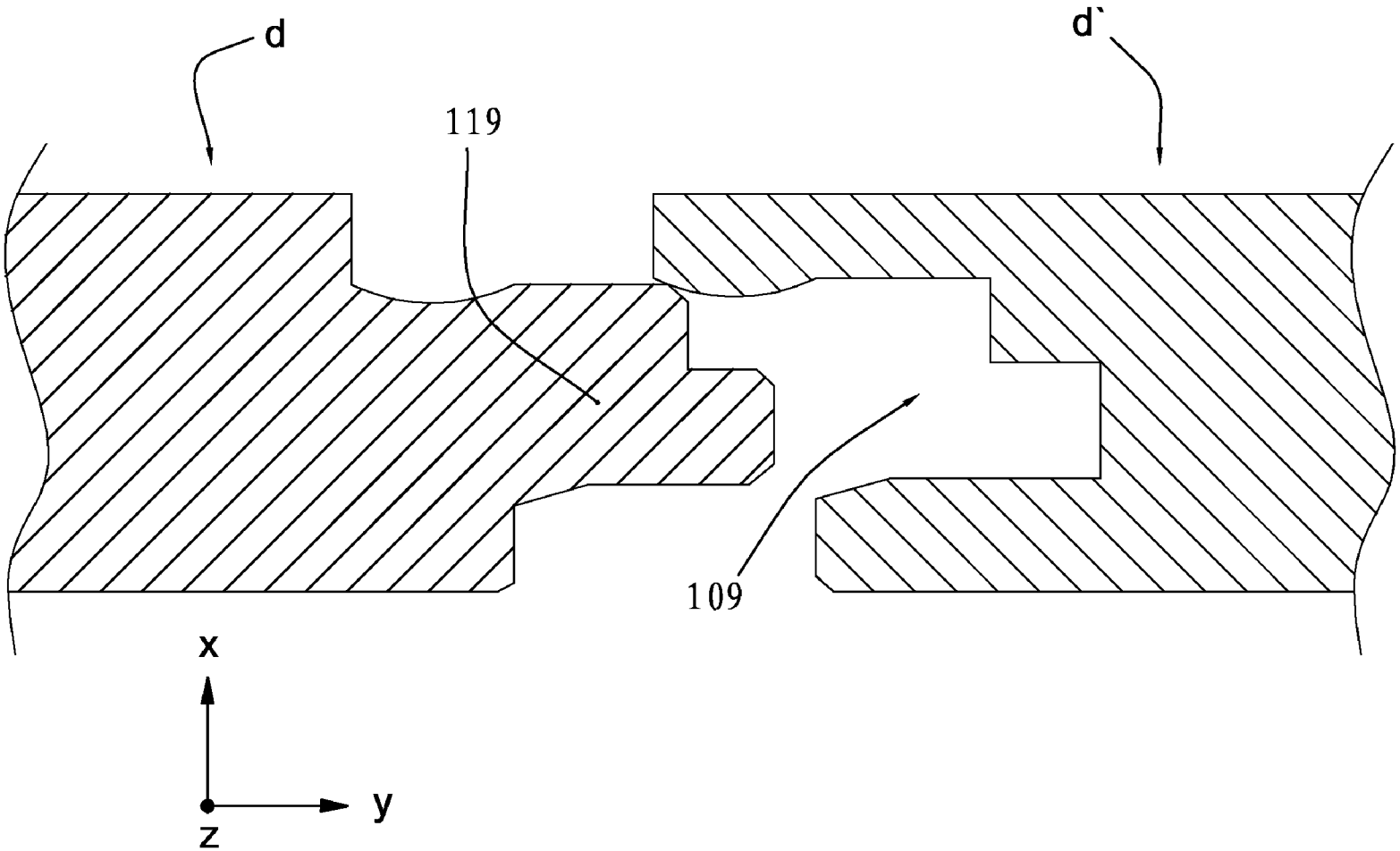
FIG. 6 shows the first stage when the floor panel with coupling devices of FIG. 2 is coupled to another identical floor panel.
Figure 7:
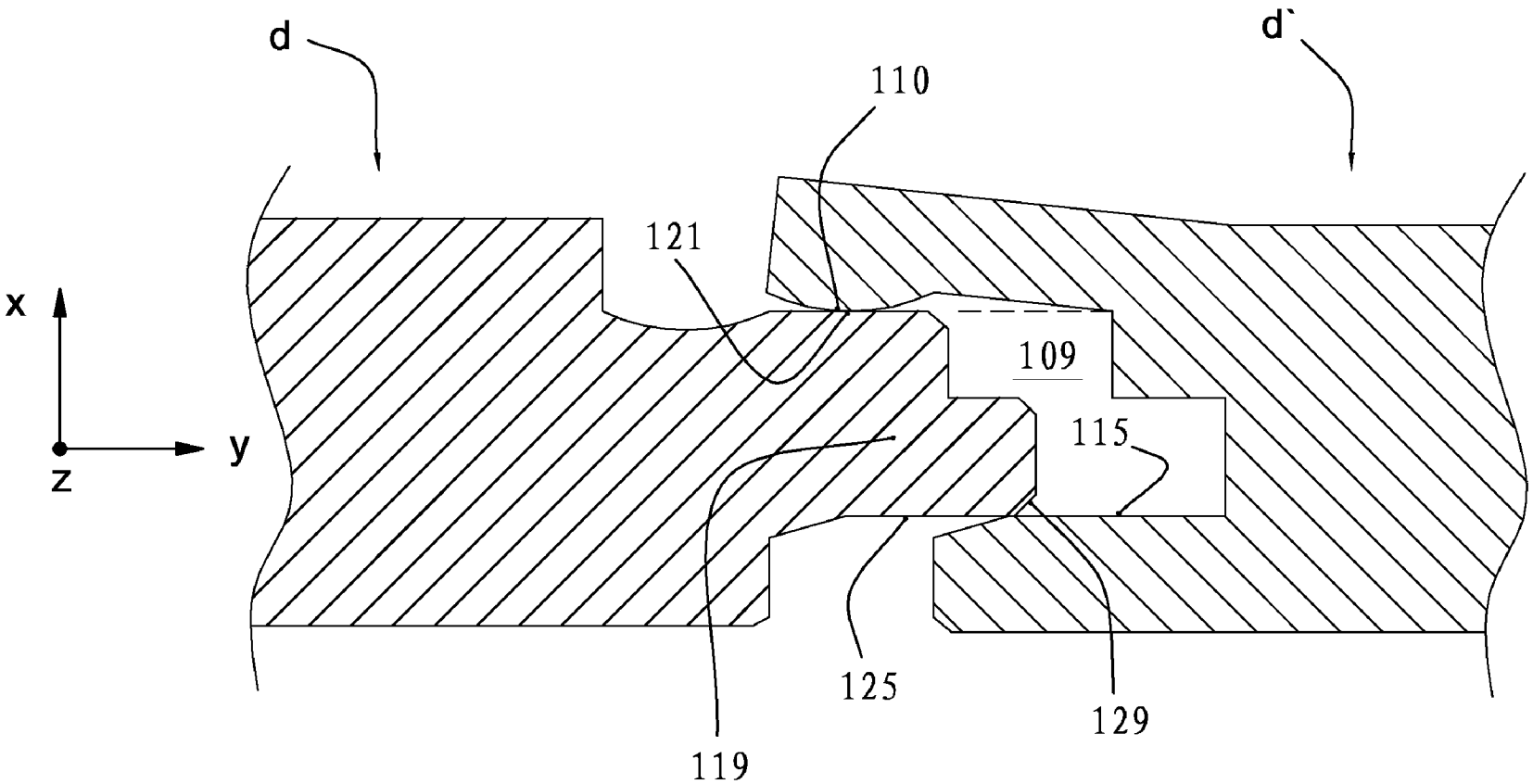
FIG. 7 shows the second stage when the floor panel with coupling devices of FIG. 2 is coupled to another identical floor panel.

The FIGS. 6, 7 and 8 show three different stages of the coupling of two floor panels with coupling devices.

As represented in FIG. 6, before coupling two identical floor panels d and d', an operator firstly aligns the tongue 119 of the floor panel d with the groove 109 of the floor panel d' and exerts a horizontal force to move the floor panel d towards the floor panel d' in the direction y.

As shown in FIG. 7, when the floor panel d is coupled to the floor panel d', the second side 121 of the floor panel d contacts the first slot wall 110 of the floor panel d' first. Then, with the tongue 119 of the floor panel d moving on, the sixth side 125 of the floor panel d is guided by the skew wall 129 into the groove 109 of the floor panel d' and contacts the sixth slot wall 115 of the floor panel d'. At the same time, the second side 121 of the floor panel d forces the upper lip where the first slot wall 110 of the floor panel d' is located deformed elastically in the direction of x so that the tongue 119 of the floor panel d can be inserted further towards the inner bottom of groove 109 of the floor panel d'.

As shown in FIG. 8, when the two floor panels d and d' are coupled together completely, the deformed upper lip where the first slot wall 110 is located returns to its normal appearance and the first slot wall 110 of the floor panel d' engages with the first side 120 of the floor panel d, which ensures that the two floor panels coupled to each other can not move laterally in the direction y with respect to each other. Meanwhile, the second end wall 117 of the floor panel d comes in contact with the first end wall 106 of the floor panel d'. In this engaged condition of the two floor panels, the difference of the length between the fourth slot wall 113 and the fourth side 123 of a floor panel, as shown in FIGS. 4 and 5, results in that the gap 130 is formed in the direction y between the fifth side 124 of the floor panel d and the fifth slot wall 114 of the floor panel d' when the two identical floor panels d and d' are coupled together. Similarly, the gap 131 can be formed in the direction y between the fourth end wall 118 of the floor panel d and the third end wall 108 of the floor panel d' in the coupled condition of the two floor panels.

I claim:

1. A floor panel with coupling devices comprising:

an upper side for treading, an underside contacting the underlying floor, a first end wall and a second end wall parallelly located at a distance from each other and perpendicular to said upper side;

a third end wall and a fourth end wall parallelly located at a distance from each other and perpendicular to said upper side, said first end wall and said third end wall being parallel to each other;

a groove located between the first end wall and the third end wall, the groove extending along a longitudinal direction of said floor panel;

a tongue extending outward between the second end wall and the fourth end wall, the tongue extending along a longitudinal direction of said floor panel;

wherein said groove orderly comprising a first slot wall, a second slot wall, a third slot wall, a fourth slot wall, a fifth slot wall and a sixth slot wall; said first slot wall connecting said first end wall and being formed by a protrusion with a curved shape which protrudes downward towards the entrance of said groove; said second slot wall, said fourth slot wall and said sixth slot wall being parallel to said upper side; said third slot wall being parallel to said first end wall and extending in a direction towards said sixth slot wall; said fifth slot wall being parallel to said first end wall;

said tongue orderly comprising a first side, a second side, a third side, a fourth side, a fifth side and a sixth side; said first side connecting said second end wall and being formed by a recess with a curved shape; said second side, said fourth side and said sixth side being parallel to said upper side; said third side being parallel to said second end wall and extending in a direction towards said sixth side;

said first slot wall having the same curved shape and arc length as said first side of said tongue so that they can be meshingly engaged when adjacent identical ones of said floor panel are coupled together; the total length of said second slot wall and said fourth slot wall being longer than that of said second side and said fourth side of said tongue.

2. The floor panel with coupling devices according to claim 1, wherein the joint portion of said first slot wall and said second slot wall aligns to the plane of said third end wall in the direction perpendicular to said first end wall, the joint portion of said first side and said second side aligns to the plane of said fourth end wall in the direction perpendicular to said second end wall.

3. The floor panel with coupling devices according to claim 1, wherein a seventh slot wall is provided between said sixth slot wall and said third end wall for widening the entrance of said groove, a seventh side is provided between said sixth side and said fourth end to reinforce the bottom portion of said tongue, and said seventh slot wall inclines at the same angle as said seventh side.

4. The floor panel with coupling devices according to claim 2, wherein a seventh slot wall is provided between said sixth slot wall and said third end wall for widening the entrance of said groove, a seventh side is provided between said sixth side and said fourth end to reinforce the bottom portion of said tongue, and said seventh slot wall inclines at the same angle as said seventh side.

5. The floor panel with coupling devices according to claim 3, wherein the joint edges between said second and third sides, said fourth and fifth sides, and said fifth and sixth sides are chamfered respectively to form corresponding skew walls which maintain certain angles with their adjacent sides.

6. The floor panel with coupling devices according to claim 4, wherein the joint edges between said second and third sides, said fourth and fifth sides, and said fifth and sixth sides are chamfered respectively to form corresponding skew walls which maintain certain angles with their adjacent sides.

7. The floor panel with coupling devices according to claim 5, wherein the length of said fourth slot wall is longer than that of said fourth side of said tongue.

8. The floor panel with coupling devices according to claim 6, wherein the length of said fourth slot wall is longer than that of said fourth side of said tongue.

9. The floor panel with coupling devices according to claim 7, wherein when said floor panel is coupled with another identical floor panel, and a gap is formed between said third end wall of said floor panel and said fourth end wall of said another identical floor panel in the direction perpendicular to said first end wall.

10. The floor panel with coupling devices according to claim 8, wherein when said floor panel is coupled with another identical floor panel, and a gap is formed between said third end wall of said floor panel and said fourth end wall of said another identical floor panel in the direction perpendicular to said first end wall.

* * * * *